US005673641A

United States Patent [19]

Sournat et al.

[11] Patent Number: 5,673,641

[45] Date of Patent: Oct. 7, 1997

[54] WIND-PROPELLED HYDROFOIL

[75] Inventors: Andre Sournat, 104 rue du General-Leclerc, 78500 Sartrouville; Alain De Bergh, 9, place Alexandre-Ier, F-78000 Versailles; Alain Thebault, 74, rue du Cardinal-Lemoine, F-75005 Paris; Philippe Perrier, 4 rue Alphose-Daudet, F8860 Saint-Nom-La-Breteche; Vincent Lauriot-Prevost; Marc Van Peteghem, both of Paris, all of France

[73] Assignees: Andre Sournat, Sartrouville; Alain De Bergh, Versailles; Alain Thebault, Paris; Philippe Perrier, Saint-Nom-Labreteche; Dassault Aviation; Architecture Navale MVPVLP, both of Paris, all of France

[21] Appl. No.: 537,720

[22] PCT Filed: Apr. 12, 1994

[86] PCT No.: PCT/FR94/00404

§ 371 Date: Dec. 29, 1995

§ 102(e) Date: Dec. 29, 1995

[87] PCT Pub. No.: WO94/23989

PCT Pub. Date: Oct. 27, 1994

[30] Foreign Application Priority Data

Apr. 13, 1993 [FR] France ..... 93 04310

[51] Int. Cl.[6] ..... B63B 1/24

[52] U.S. Cl. ..... 114/39.1; 114/61; 114/274

[58] Field of Search ..... 114/61, 123, 39.1, 114/271, 274, 275, 276, 277, 278, 282, 283, 291, 292

[56] References Cited

U.S. PATENT DOCUMENTS

| | | | |
|---|---|---|---|
| 2,890,672 | 6/1959 | Boericke | 114/274 |
| 3,789,789 | 2/1974 | Cleary . | |
| 4,100,876 | 7/1978 | Feleus | 114/274 |
| 5,054,410 | 10/1991 | Scarborough . | |
| 5,113,775 | 5/1992 | Imhoff | 114/274 |

FOREIGN PATENT DOCUMENTS

| | | |
|---|---|---|
| 1456080 | 9/1965 | France . |
| 2138062 | 12/1972 | France . |
| 2659287 | 9/1991 | France . |
| 0358888 | 3/1990 | Germany . |

OTHER PUBLICATIONS

Charles Heidsieck, l'albatros, Bateaux, No. 316, Sep., 1984; Model Tests For A Wind–Propelled Hydrofoil Trimaran, By Neil Bose, High Speed Surface Craft.

*Primary Examiner*—Stephen Avila
*Attorney, Agent, or Firm*—Bachman & LaPointe, P.C.

[57] ABSTRACT

A wind-propelled hydrofoil comprising a forward assembly with at least partially submerged forward foils and a fully submerged aft foil. The forward foils (43, 44) are such that the resultant of the vertical forces drops when said assembly is translated vertically upwards, with a heave characteristic (F), and increases when said forward assembly is subject to upward pitching, with an incidence characteristic (A). The aft foil (46) has an incidence characteristic (R) such that $R(d-g)-Ag+F(g^2+r^2)>0$, wherein d is the distance between the aft foil (46) and the center of heave, g is the distance between the center of gravity and the center of heave, and r is the gyration radius of the hydrofoil.

17 Claims, 7 Drawing Sheets

Figure 1:
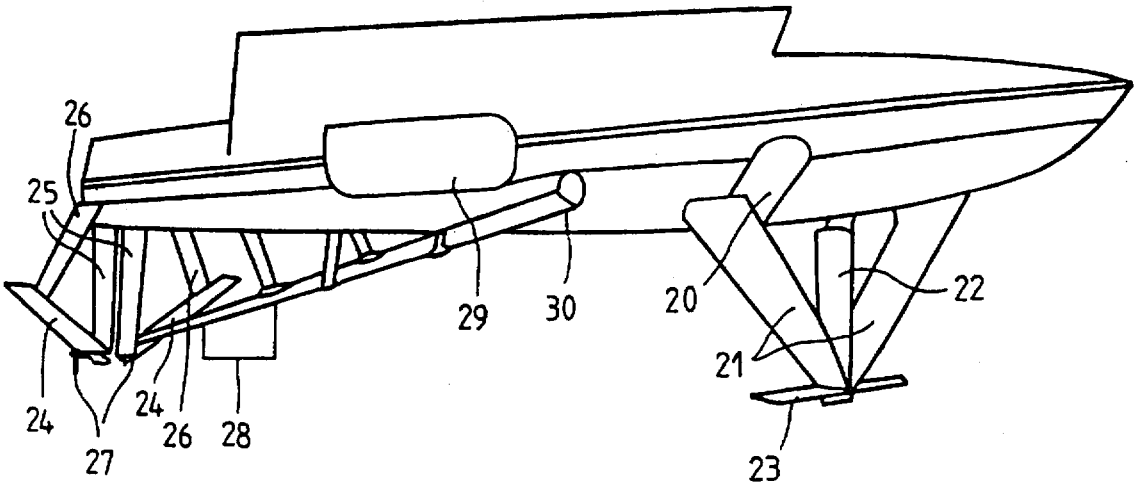
FIG 1 PRIOR ART

FIG_9a
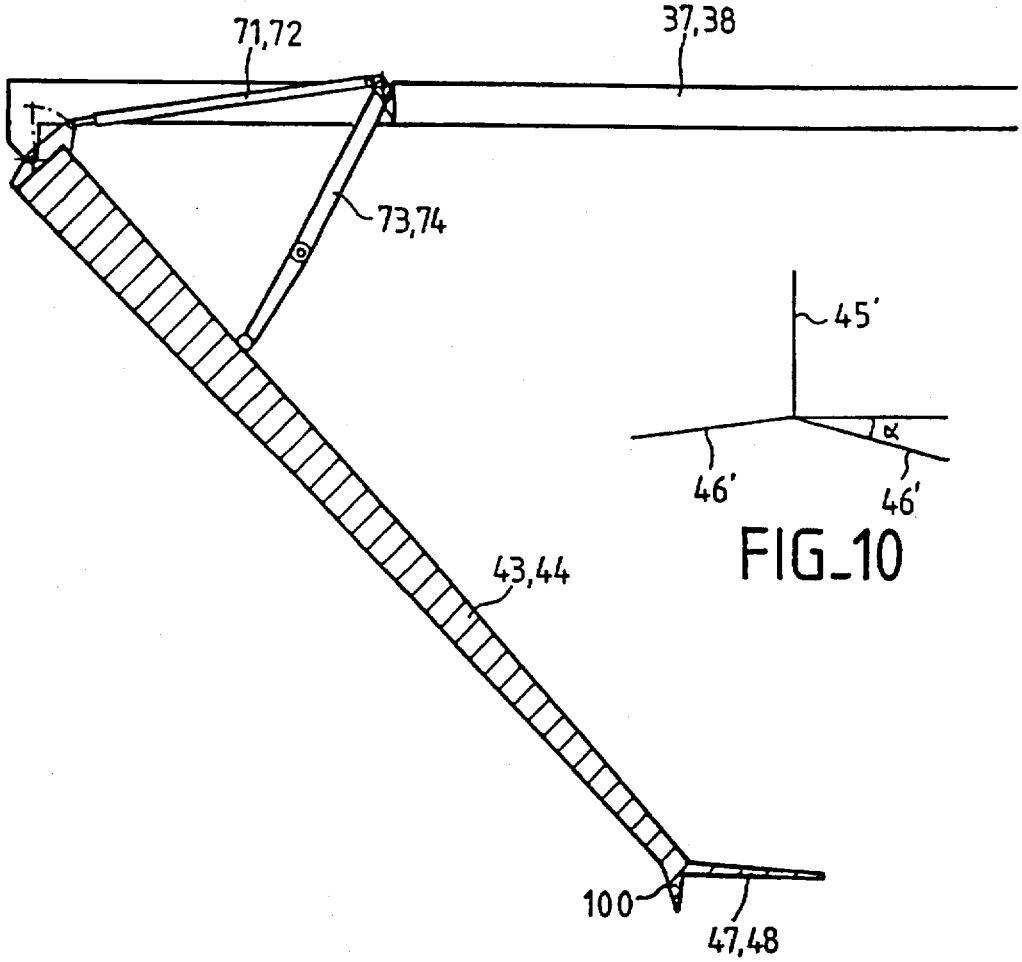
FIG_10
FIG_9b
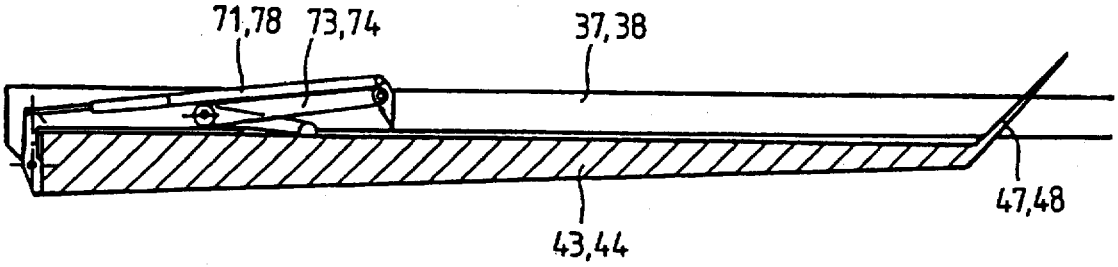

WIND-PROPELLED HYDROFOIL

The present invention concerns a wind-propelled hydrofoil of the type comprising a forward assembly with at least partially submerged forward foils and a fully submerged aft foil.

The theory of balancing the weight of a vessel by a hydrodynamic lift effect produced by the speed of the water acting on submerged, semi-submerged or surface-piercing aerofoil shape members, as opposed to use of only the Archimedian upthrust effect due to the submerged volumes, goes back a long way and powered vessels fitted with this type of device date from the beginning of the twentieth century.

The first patent application concerning a hydrofoil, filed by the French inventor FARCOT, dates back to 1869.

In 1909 Roger RAVAUD built a powered vessel called the "motoscaphe".

Another powered hydrofoil built by the Italian FORLANINI in 1911 had foils arranged like the rungs of a ladder.

In 1907 CROCCO and RICALDONI built a monoplane machine with V-shape surface-piercing aerofoils. The submerged surface area varied automatically with the weight and the speed which made the machine stable and gave it a particular heave characteristic. This V-shape arrangement of surface-piercing foils was very widely used on first generation hydrofoils and has the drawback that the foils tend to follow undulations of the swell, which makes a vessel of this kind uncomfortable for passengers. What is more, once the swell height exceeds 1.5 m it is necessary to reduce the speed of the hydrofoil very substantially.

The V-shape foil design was therefore abandoned in second generation hydrofoils which have simple, variable angle of incidence, totally submerged foils controlled automatically according to the speed, the trim and the height of the vessel above the water, a control system sending the necessary corrections to the foils. The second generation powered hydrofoils were introduced during the 1960s and have mainly been used in military applications. The design of these hydrofoils is inherently unstable, stability being achieved only dynamically by means of a dedicated control system.

Turning to wind-propelled hydrofoils, racing vessels have been built that can achieve high speeds in calm water. However, these vessels have major stability problems and become virtually unusable if there is any swell.

Patents U.S. Pat. No. 5,054,410 (SCARBOROUGH) and U.S. Pat. No. 3,789,789 (CLEARY) describe wind-propelled hydrofoils having a forward foil that is partially submerged, an aft foil and a dynamic compensator device. These hydrofoils are not inherently stable. In patent U.S. Pat. No. 5,054,410 the aft foil is totally submerged and the hydrofoil is not inherently stable, stability being achieved entirely dynamically. In patent U.S. Pat. No. 3,789,789, the aft foil is not totally submerged; it rises to the surface of the water and no longer acts as a foil but as a water ski or skate, imposing a fixed height above the water at the stern.

A dynamically stabilized hydrofoil is described in "Model tests for a wind-propelled hydrofoil trimaran" by Neil BOSE published in HIGH-SPEED SURFACE CRAFT, vol. 20, n° 10, Oct. 1981, London, p28–31. This hydrofoil has a surface-piercing V-shape forward foil, like the aft foil, and which is not totally submerged.

An object of the present invention is to provide a wind-propelled hydrofoil that is inherently stable.

The basic idea of the invention is to start from a prior art wind-propelled hydrofoil having a forward assembly comprising at least partially submerged forward foils and a fully submerged aft foil, the latter accordingly having no heave characteristic.

The basis of the present invention is recognition of the fact that a particular arrangement of the component parts of a wind-propelled hydrofoil of this type can provide longitudinal stability and in particular longitudinal stability compatible with sailing in high seas.

The present invention therefore concerns a wind-propelled hydrofoil of the above type characterized in that the forward foils are such that the resultant of the vertical forces:

decreases when said forward assembly moves vertically upwards, said resultant having a heave characteristic F increases when said forward assembly is subjected to an upward pitching movement, with an incidence characteristic A and in that the aft foil has an incidence characteristic R satisfying the following equation:

$$R(d-g)-Ag+F(g^2+r^2)>0$$

in which d is the horizontal component of the distance between the aft foil and the center of heave of the forward assembly, g is the distance between the center of gravity of the hydrofoil and the center of heave of the forward assembly, and r is the gyration radius of the hydrofoil.

The above terms are defined hereinafter.

By virtue of the stability condition in accordance with the invention, any departure from an equilibrium position due to any combination of pitching and heaving produces a variation in hydrodynamic forces tending to return the vessel to its equilibrium position.

The hydrofoil is advantageously of the multihull type with a central hull and two lateral floats, the forward foils being carried by the lateral floats and converging symmetrically towards the central hull.

The hydrofoil can then include booms joining the central hull and the lateral floats that are supported by stays fixed to the central hull and steps extending from the prow of the central hull at least as far as the point at which each stay is fixed to the central hull, the fixing point of each stay being disposed above the base of the step. Thus, when the hydrofoil encounters a heavy sea, the step deflects the water away from the stay fixing points, which prevents the production of an instantaneous force tending to destabilize the hydrofoil.

The aft foil is advantageously mounted at the lower end of a vertical rudder blade. The aft foil can be symmetrical on either side of the rudder blade. In a preferred embodiment the aft foil is mounted on a vertical axle coupled to a trigger system so that it is able to retract by rotating when acted on by a torque exceeding a given nominal value. The aft foil can be mounted by means of a torsion tube held by a roller adapted to retract and to compress a spring as it retracts, so as to limit torsion forces to said nominal value.

The hydrofoil can also include a device for rotating the rudder blade comprising a drive lever operating a mobile flap mechanically attached to an end of the rudder blade opposite its axle. It may include a drive device between the drive lever and the mobile flap comprising a lever arm amplifying link-crank mechanism and a torsion tube connecting the link-crank mechanism to the drive lever. It can also include a spring box disposed between the drive lever and the rudder blade so that the torsion tube transmits force only if the resisting force of the rudder blade exceeds the setting of the spring box. Accordingly, if the resisting force of the rudder blade is less than the setting of the spring box, the drive lever drives the rudder blade directly, the amplifying link-crank mechanism and the mobile flap coming into play for higher values of this force.

In an advantageous embodiment of the hydrofoil the aft foil is adjustable about a transverse horizontal axis so that hydrofoil trim and difference of draught conditions can be chosen to achieve the best possible performance. This adjustment does not directly influence stability since the position of said horizontal plane is usually fixed and is only adjusted from time to time as sailing conditions change.

The hydrofoil can also include a device for raising the rudder blade and/or the forward foils, converting the hydrofoil to a conventional trimaran configuration.

The hydrofoil can also include a water ballast tank to shift the center of gravity aft when sailing at high speed.

Given that taking on ballast is required only above a certain speed, an advantageous implementation of the system for taking on ballast consists in a tube passing under the surface of the water and the opening at the bottom end of which faces forwards so that ballast is taken on automatically due to the effect of the dynamic pressure of the water. A submerged tube of this kind can fill a tank 1.30 m above the surface of the water at speeds in excess of 10 knots, for example.

To reduce the hydraulic resistance of the submerged tube, in an advantageous embodiment of the invention the tube is inside the rudder blade with the opening at its lower end in the lower part of the leading edge of the rudder blade, which is still submerged when the hydrofoil operates with the aid of hydrodynamic lift.

Figure 2:
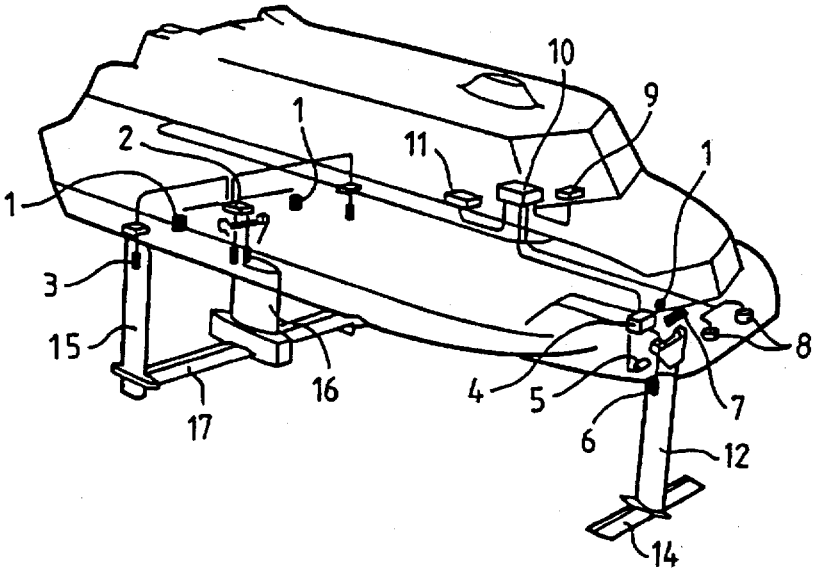
FIG 2 PRIOR ART
Figure 3:
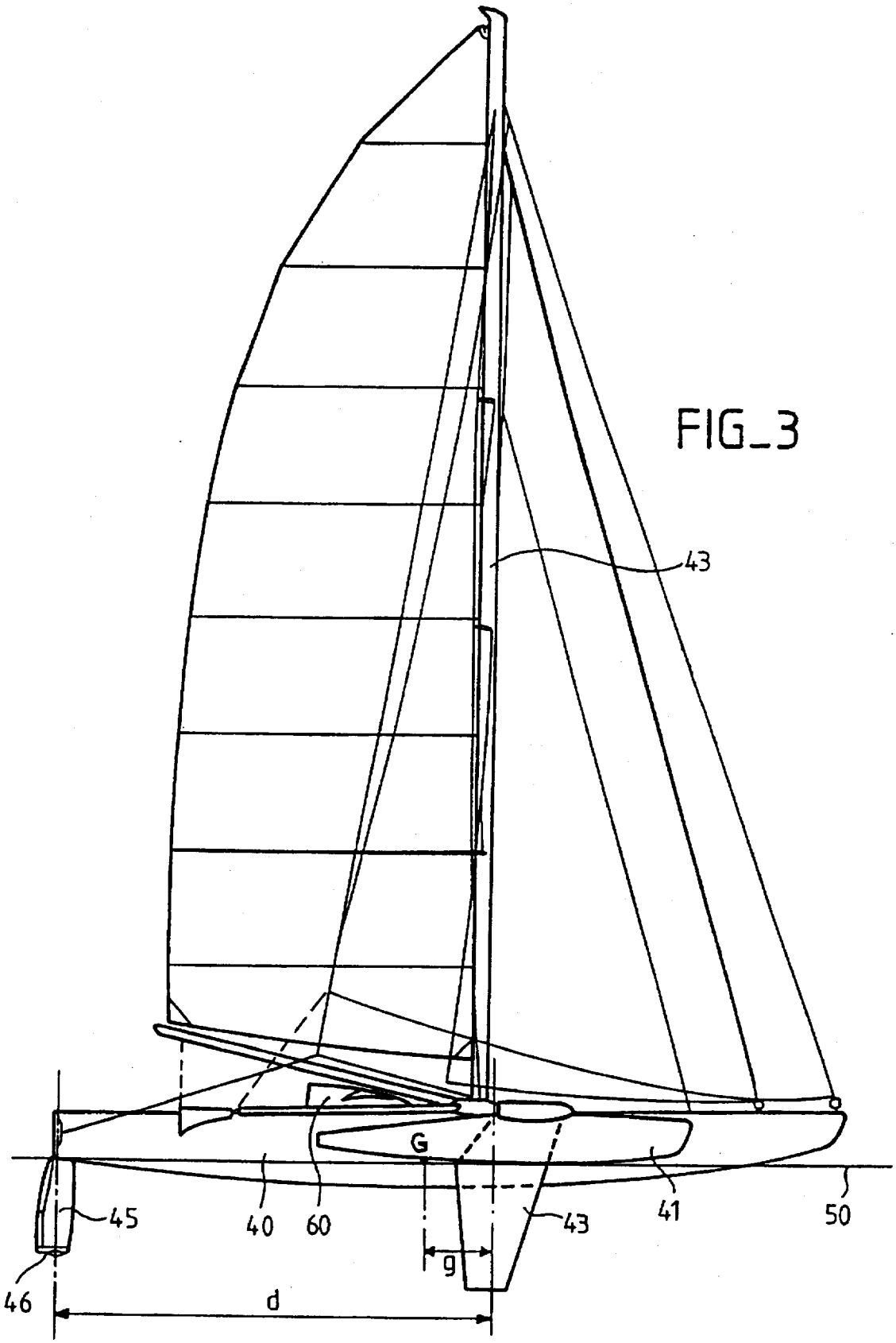
Figure 4:
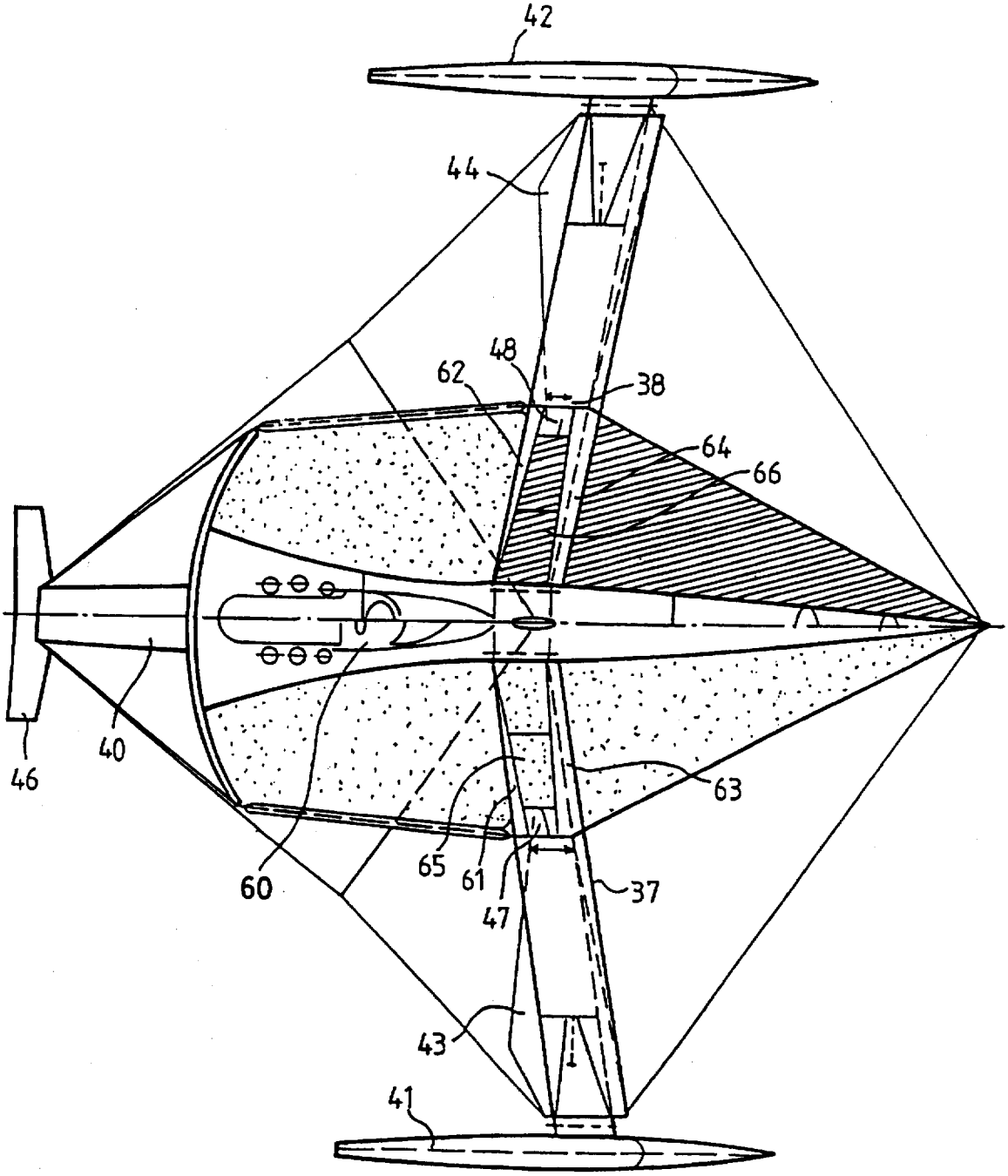
Figure 5A:
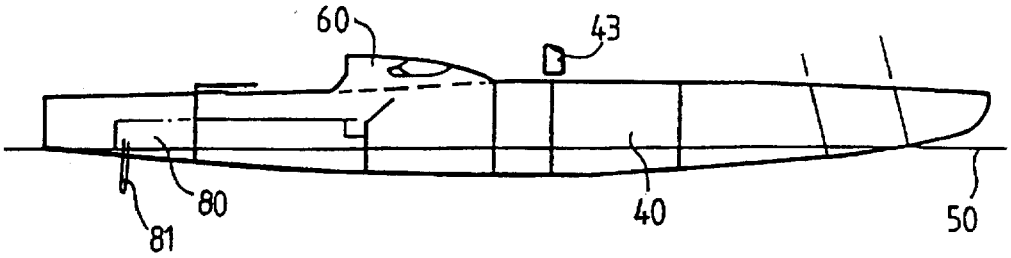
Figure 5B:
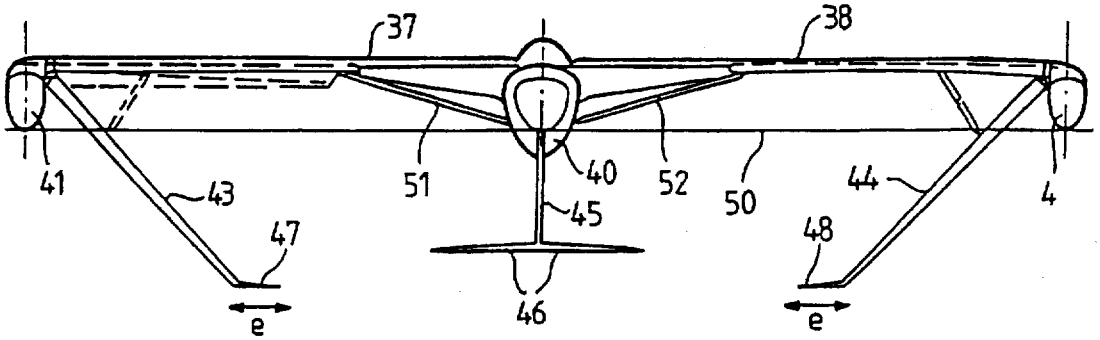
Figure 6A:
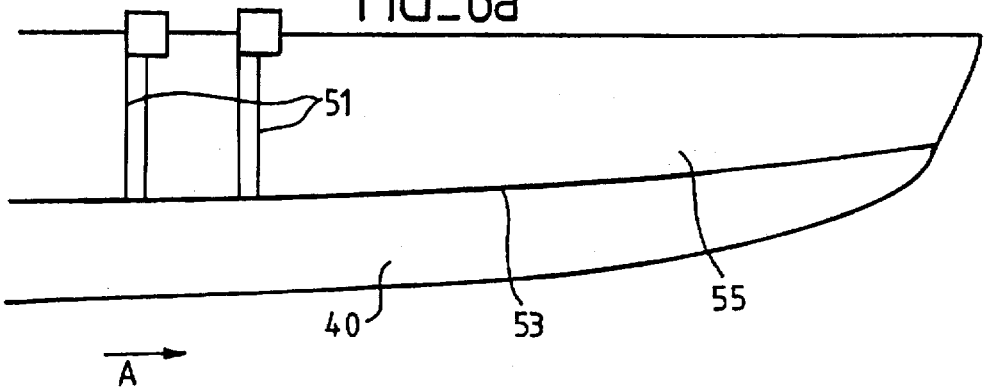
Figure 6B:
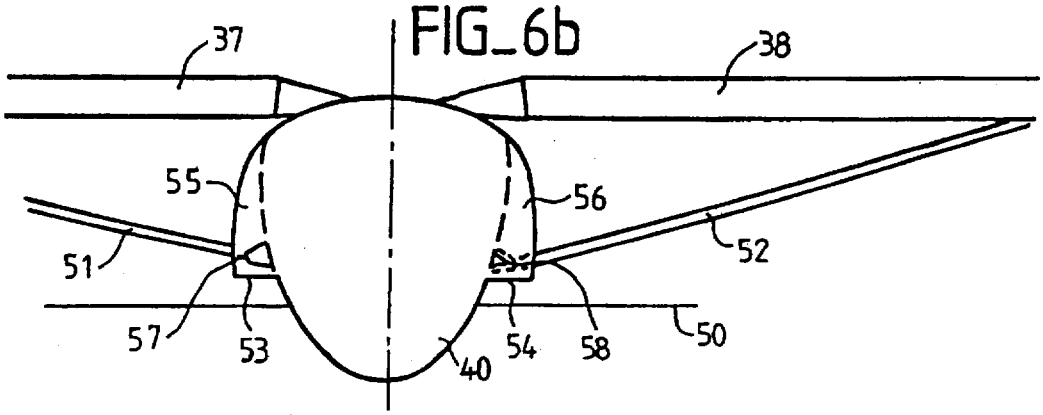
Figure 7:
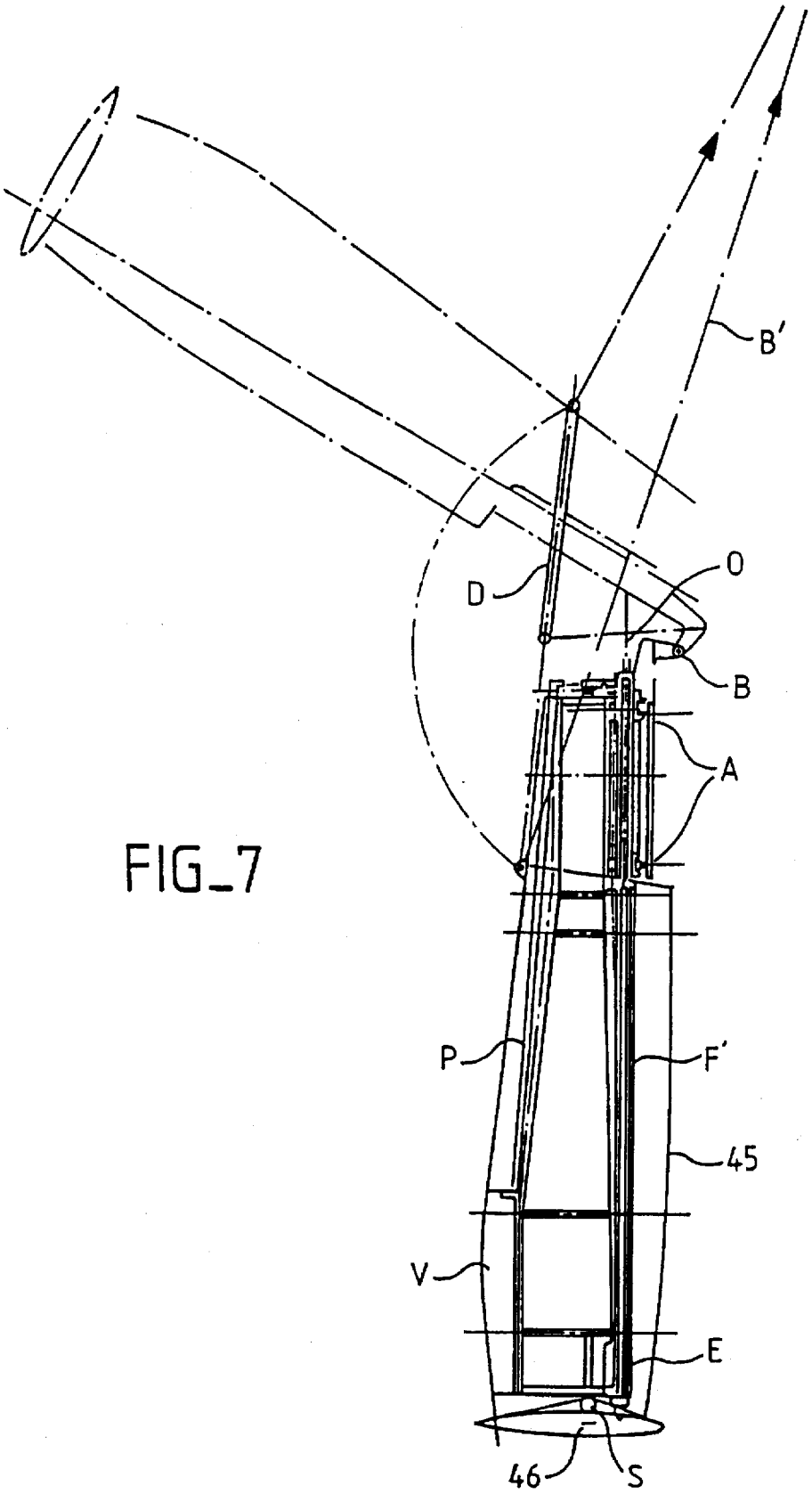
Figure 8:
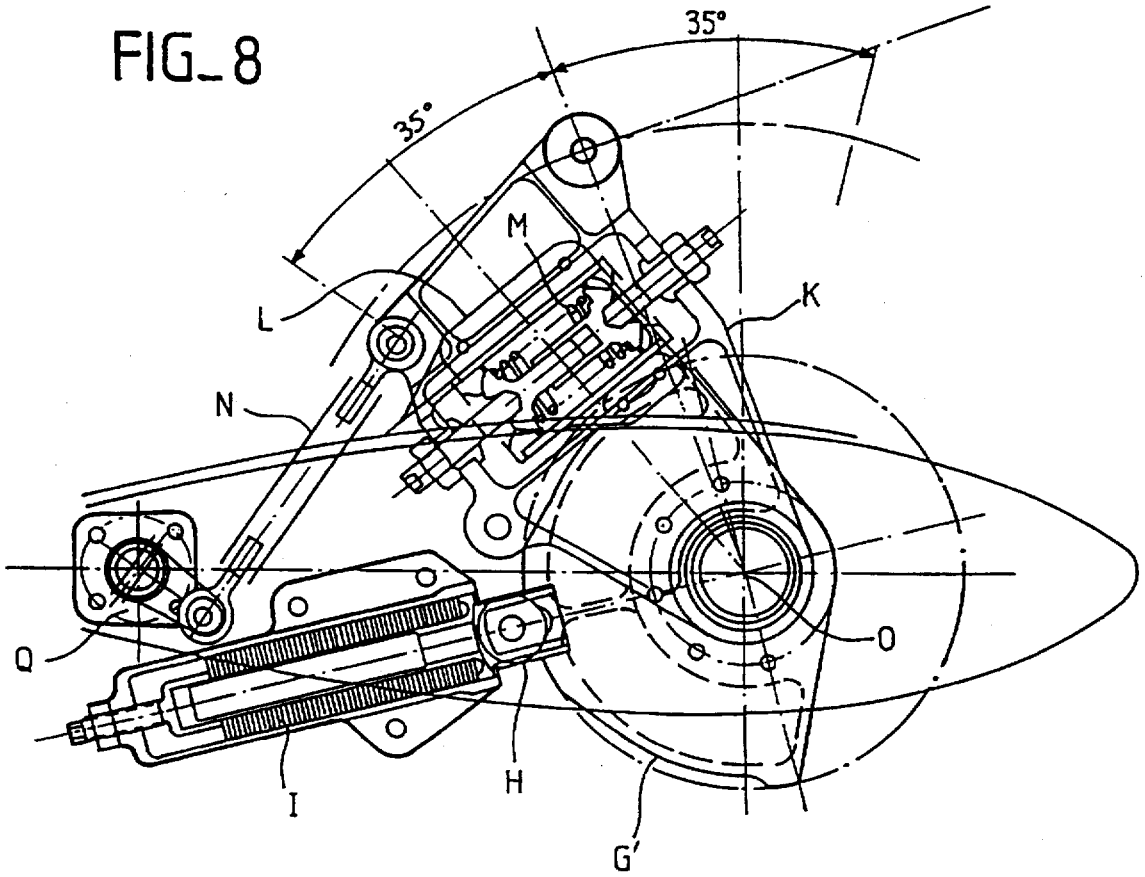

Other features and advantages of the invention will emerge from a reading of the following description given by way of non-limiting example with reference to the drawings, in which:

FIGS. 1 and 2 show first and second generation prior art powered hydrofoils, respectively, FIGS. 3 and 4 are respectively side and top views of a hydrofoil in accordance with the invention, FIGS. 5*a* and 5*b* are respectively partial side and head-on views of a hydrofoil in accordance with the invention, FIGS. 6*a* and 6*b* are respectively side and head-on views showing the provision of protective steps in accordance with the invention, FIGS. 7 and 8 show a rudder blade control device in a preferred embodiment of the invention, FIGS. 9*a* and 9*b* show a device for raising the forward foils in deployed and retracted positions, respectively, and FIG. 10 shows an alternative embodiment of the aft foil.

FIG. 1 is a schematic representation of a CANTIERE NAVAL TECHNICA SpA RHS 160 hydrofoil that has V-shape forward foils 21, a forward foil 23 and a vertical strut 22. An aft assembly includes two foils 24, vertical struts 25 and support arms 26. This vessel has two diesel engines 29, a gearbox 30, transmission shafts 28 and propellers 27 at the bottom of the vertical struts 25. As already mentioned, the forward and aft V-shape foils of the hydrofoil cause the submerged surface area to vary automatically with weight and speed, and so the foils follow undulations of the swell and the vessel is particularly uncomfortable for passengers in high seas.

FIG. 2 shows a second generation hydrofoil designed by BOEING. The forward foil 14 is joined to the hull by a vertical strut 12 and the aft foil 7 is joined to the hull by a central strut 16 and two lateral struts 15. The struts 15 are used to control aft drift. The device includes a vertical accelerometer 1, an aft junction box 2, an aft drift control 3, a steering control 4, a forward junction box 5, a forward drift control 6, a lateral accelerometer 7, wave height sensors 8, an automatic control system (ACS) 9, a computer 10 and a position control panel 11. The set of foils of a hydrofoil of this kind is not inherently stable, stability being achieved only dynamically by the control system mentioned above.

There is currently no hydrofoil having inherently stable characteristics enabling it to sail in high seas. The constraints are even more difficult for wind-propelled hydrofoils, which do not have a powerful engine. What is more, an inherently stable design has the advantage of simplicity of construction, avoiding reliability problems in the case of long and difficult crossings.

As shown in FIGS. 3 and 4, the hydrofoil of the present invention is in the form of a trimaran having a central hull 40 and two lateral floats 41 and 42 linked to the central hull by booms 37 and 38 which divide, near the hull 40, into two arms 61 and 63, in the case of the boom 37, and two arms 62 and 64, in the case of the boom 38. The forward foils 43 and 44 are fixed to the inboard edges of the floats 41 and 42 and extend towards each other and towards the central hull (see also FIG. 5*b*).

The horizontal aft foil 46 is fixed to the bottom part of a rudder blade 45 constituting the rudder of the hydrofoil.

FIG. 4 shows the cockpit 60 and the spaces 65 and 66 between the arms 61, 63 and 62, 64, respectively.

The waterline of the hydrofoil at rest is shown by the line 50.

With particular reference to FIGS. 3 and 4, the forward foils 43 and 44 have, starting from their root, a trapezoidal first part widening from the floats 41 and 42 as far as a maximal width part approximately at the 35 waterline 50 when the hydrofoil is at rest. The foils are then continued downwards by a trapezoidal second part which narrows, and are extended by small horizontal foils or ailerons 47 and 48.

The ailerons 47 and 48 advantageously have a chord c' less than or equal to that (c) of the distal end of the foils 43 and 44 and their span e is at least three times the chord c', extending in a substantially horizontal direction towards the plane of symmetry of the hydrofoil (see FIGS. 4 and 5*b*).

As shown in FIG. 5*b* in particular, the booms 37 and 38 are supported by twin reinforcing arms 51 and 52 disposed under the arms 61 through 64 and fixed between a part of the hull above the waterline 50 and the distal end (relative to the hull) of the arms 61 through 64, in such a way as to leave the spaces 65 and 66.

The stability conditions for a hydrofoil as shown in FIGS. 3, 4, 5*a* and 5*b* will now be defined.

Let d denote the horizontal component of the distance between the transverse axis of the aft foil 46 and the center of heave in line with the forward foils 43 and 44.

Let g denote the distance between the center of gravity of the hydrofoil and the center of heave, this distance being positive for a center of gravity G aft of the center of heave.

Let r denote the gyration radius of the hydrofoil, defined as the length whose square is equal to the ratio between the moment of inertia of the hydrofoil in rotation about a transverse axis through the center of gravity and the mass of the hydrofoil.

The center of heave P is the point of application of variations in vertical loads generated by vertical movement of the hydrofoil with no variation in speed or trim from an equilibrium state.

The heave characteristic F is the ratio between the variation in the resultant of the vertical forces and the amplitude of vertical displacement generated by this variation. In other words, it is the derivative of the lift of the hydrofoil as a function of its difference of draught. The heave characteristic F is positive for a resultant of vertical forces oriented downwards when the vessel is moving upwards.

Since only the forward foil is subject to variation in the submerged surface area with vertical displacement of the hydrofoil, the heave characteristic F is due only to the presence of the front foils 43 and 44 and as a result the center of heave P is in the median vertical plane of the front foils 43 and 44.

The incidence characteristic A of a foil is defined as the ratio between the variation in the resultant of vertical forces generated by rotation about a transverse axis and the corresponding rotation angle in radians. In other words, it is the derivative of the lift as a function of the trim. The incidence characteristic A is positive for a variation in the resultant of vertical forces oriented upwards for an upward pitching movement.

The resultant of vertical forces for the forward foils 43 and 44 decreases as the forward assembly moves vertically upwards, this resultant having a positive heave characteristic F. The resultant of vertical forces increases when said forward assembly is subject to an upward pitching motion. The forward assembly has an incidence characteristic A. Finally, the rear foil also has an incidence characteristic R, but a null heave characteristic.

The stability characteristic of the hydrofoil is given by the following equation:

$$C=R(d-g)-Ag+F(g^2+r^2)>0$$

The stability condition of the invention is such that any departure from an equilibrium position due to any combination of pitching and heaving produces a variation in the hydrodynamic forces tending to return the vessel to its equilibrium position. In particular, consider momentary greater submersion due to the swell of the forward foils 43 and 44: their lift tends to increase suddenly, causing the bow to pitch up. In this configuration, the aft foil compensates or overcompensates this phenomenon and the increase in its lift counteracts the upward pitching of the bow of the hydrofoil, which compensates and therefore limits the effect of pitching. Since the aft foil has no heave characteristic, however, its stabilizing effect is such that the hydrofoil does not follow movements of the swell. This drawback of first generation hydrofoils is therefore avoided.

As a result, the combination of the forward foils having a heave and upward pitching characteristic and an aft foil having only an upward pitching characteristic has made it possible to achieve stability conditions that could not have been achieved with other prior art configurations.

There is an upper limit on the size of the aft foil 46 due to the drag it produces and the consequences thereof in terms of vessel performance.

The hydrodynamic characteristics of submerged, semi-submerged or surface-piercing foils can be determined by means that are known in themselves, in particular by tank tests using full-scale or reduced scale models, by flow calculations on a computer or by measuring forces on a prototype. Reference may be had to "Résistance à l'avancement dans les fluides" ("Resistance to forward motion in fluids") by S. F. HOERNER, Gautier-Villard, Paris, 1965.

Methods known in themselves can also be used to evaluate the weight, the position of the center of gravity and the moments of inertia of the hydrofoil.

The determination of these various characteristics is part of the usual design effort in respect of a hydrodynamic lift type vessel. In its most general form, the invention does not concern a particular type of foil, but rather a disposition of the foils relative to each other and more importantly relative to the center of gravity of the vessel, whereby the balancing of the mass of the hydrofoil and propulsion forces by hydrodynamic lift forces is stable and enables the hydrofoil to remain in a state of equilibrium with no control system.

In an advantageous embodiment of the hydrofoil it is possible to adjust the rear foil about a transverse horizontal axis to choose trim and difference of draught conditions for the hydrofoil providing the best possible performance. This adjustment has no direct influence on stability since the position of said horizontal plane is usually fixed and is varied only from time to time as sailing conditions change.

APPLICATION EXAMPLE

The hydrofoil comprises a pair of forward foils 43 and 44 symmetrically disposed about the plane of symmetry of the vessel and a totally submerged aft foil 46. The aft foil is 4 m aft of the line between the forward foils (d=4 m). The center of gravity of the vessel is 0.65 m aft of the line between the forward foils (g =0.65 m). The gyration radius r of the fully laden vessel about the pitch axis is 2.1 m. The weight of the fully laden vessel is 400 kg.

Design work and tests on the forward foils 43 and 44 have shown that the vertical component of the force developed by each foil varies as a function of the trim of the foil, the depth to which it is submerged and the speed of the vessel. This force is correctly given for each foil by the following formulas:

for a depth of 0.850 m (and a vertically projected surface area of 0.53 $m^2$ for each foil)

$$Fa1=750\times a\times v^2$$

for a depth of 0.450 m $$Fa2=370\times a\times v^2$$

where a is the trim (or incidence) of the foil in operation, expressed in radians, and $v^2$ is the square of the speed of the vessel expressed in m/s; the forces Fa1 and Fa2 are expressed in N.

Design work and tests on an aft foil 46 with a span of 1.5 m and a surface area of 0.34 $m^2$ show that the vertical force it develops is accurately expressed by the following formula;

$$Fr=660\times b\times v^2$$

where b is the incidence of the aft foil expressed in radians; the force Fr is expressed in N.

The incidence of the foil can be varied from the cockpit and the incidence b is independent of the trim a of the vessel, although their instantaneous variations must be regarded as identical.

Heave Characteristic F

Assuming that the vertical component of the forces applied to the forward foils varies as a linear function of depth of submersion, it can be deduced that the heave characteristic for both forward foils has the value:

$$F=2\times(Fa1-Fa2)/(0.850-0.450)$$

$$F=2\times(750\times a\times v^2-370\times a\times v^2)/(0.850-0.450)$$

$$F=1\,900\times a\times v^2$$

Numerical Application

The following values can be assigned to each parameter, independently of the depth of immersion:

$g=0.65$ m
$r=2.10$ m
$d=4$ m
$F=1\ 900\times a\times v^2$
$R=660\times v^2$

For a depth of immersion of 0.85 m:
$A=2\times750\times v^2=1\ 500\times v^2$
and for a depth of immersion of 0.45 m:
$A=2\times370\times v^2=740\times v^2$ Application of the equilibrium equation C gives:

for the 0.85 m depth of immersion:

$$C=R\times(d-g)-Axg+F\times(g^2+r^2)$$
$$=(660\times v^2)\times(4-0.65)-(1\ 500\times v^2)\times0.65$$
$$+(1\ 900\times a\times v^2)\times(0.65^2+2.12)$$
$$C=(1\ 236+9\ 180\times a)\times v^2>0$$

for the 0.45 m depth of immersion:

$$R\times(d-g)-Axg+F\times(g^2+r^2)$$
$$=(660\ v)\times(4-0.65)-(740\ v^2)\times0.65$$
$$+(1\ 900\times a\times v^2)\times(0.65^2=2.1^2)$$
$$C=(1\ 730+9\ 180\times a)\times v^2>0$$

The condition is therefore satisfied for both depths of immersion for any value of the trim a. The numerical value of the term C decreases as the depth of immersion increases. In other words, and this applies in all cases, if the condition is satisfied for the maximal depth of immersion (i.e. on sewing up), it is always satisfied regardless of the depth of immersion and therefore of the speed of the vessel.

CONTRASTING EXAMPLE

Assume that the center of gravity of the vessel is 1.80 m aft of the forward foils and that the vessel is sailing with a trim of 3.5° (0.06 radians). Application of the equilibrium equation with $g=1.8$ m
$a=0.06$ rd Gives for the 0.85 m depth of immersion $$R(d-g)-Ag+F(G^2+r^2)=$$
$$660\times v^2(4-1.8)-1\ 500\ v^2\times1.8+1\ 900\ a\ v^2\ (1.82+2.1^2)$$
$$(1\ 452-2\ 700+872)v^2=-376\ v^2<0$$

The condition is not satisfied.

By way of design rules, instabilities can be remedied:

by increasing the size of the aft foil 46, by moving the latter aft, by moving the center of gravity forward, by increasing the trim of the forward assembly, by decreasing the depth of immersion of the forward assembly, by increasing the gyration radius r.

The dynamic behavior of the combination of the booms 37, 38 and the main foil 43, 44 is highly sensitive to the stiffness in flexing and torsion of the boom (see FIG. 4).

To achieve satisfactory stiffness in combination with minimum weight, the solution adopted is to attach the boom 37, 38 to each side of the main hull 40 by means of two support brackets 57, 58 on the hull 40 and two stays 51, 52 just above the waterline 50.

This has the drawback that if the stays 51, 52 enter the water a high braking force is generated. It is therefore little used on conventional multihull vessels, although it is highly suitable for hydrofoils in which the hull is lifted out of the water at high speeds so that the stays 51 and 52 are held out of contact with the water, unless the sea is very rough, in which case the sudden braking forces are hazardous.

To limit the effects of impact of the sea on the brackets 57, 58 attaching the stays 51 and 52, the latter are placed within fairings 55, 56 on the hull and including steps 53, 54.

These fairings have a two-fold role:

streamlining of the brackets 57 and 58, additional support by a double effect: dynamic lift effect of the steps 53, 54 and hull size increasing effect of the fairings 55, 56.

As Shown in FIGS. 6*a* and 6*b*, the hull 40 has substantially horizontal steps 53 and 54 on each side. The arms 51 and 52 which support the booms 37 and 38 are fixed to the hull 40 at points 57 and 58 which are above the plane of the steps 53 and 54 and protected by the fairings 55, 56. As a result, in the presence of swell, the steps 53 and 54 deflect water away from the brackets 57 and which prevents the generation of forces on the hydrofoil that could sharply brake and destabilize it.

The T-shape aft foil 46 can lead to instantaneous stability problems at high speeds in high seas. As the speed increases, the hull 40 rises higher and higher above the surface of the water and the aft foil 46 may get dangerously close to the surface. The lift that it generates when sufficiently submerged can then suddenly disappear. It is possible, at high speeds, to balance the vessel by inertia forces alone. As this type of balancing is used only in certain sailing conditions, a ballast tank 80 is provided at the rear of the vessel fed by a retractable tube 81 so that the ballast tank 80 can be filled with sea water and drained to prevent compromising the performance of the vessel at low speeds. This type of ballasting is known in itself but until now has not been associated with the stability conditions of an aft foil. In particular, given that the value of the term C of the stability condition increases with speed, the displacement of the center of gravity G aft at high speeds does not have any drawback provided that C remains positive.

Given that taking on ballast is required only beyond a certain speed, an advantageous embodiment of the filler system consists in a tube dipping beneath the surface of the water and the orifice at the lower end of which faces forward so that the ballast tank is filled automatically by the effect of the dynamic pressure of the water. A submerged tube of this kind can fill a tank 1.30 m above the surfade of the water at speeds in excess of 10 knots, for example.

To reduce the hydraulic resistance of the submerged tube, in one advantageous embodiment of the invention the tube is inside the rudder blade and the orifice at its lower end is in the lower part of the leading edge of the rudder blade, which is still submerged when the hydrofoil is operating with hydrodynamic lift.

As mentioned above, the steps 53 and 54 provide additional support by virtue of a dynamic lift effect and by an effect of increasing the volume of the hull, over and above their function of providing fairings for the brackets attaching the arms 51, 52.

The mechanism for actuating the rudder blade 45 and the aft foil 46 will now be described with reference to FIGS. 7 and 8.

The assembly comprising the rudder blade 45 and the aft foil 46 is normally fixed to the stern board of the vessel by four quick-release fixings A, a horizontal pivot B enabling the assembly to be raised. After demounting the fixings A the assembly can be raised by pulling on a line B' and locked in the raised position by two struts D in a V-shape configuration. At low speeds the assembly is raised and an ancillary rudder blade is fitted to the stern board.

When sailing with the rudder blade 45 and the foil 46 lowered, a mechanism retracts the aft foil 46 should it encounter a buoy rope or any other obstacle. It retracts about a vertical axis E. The aft foil 46 is held in position by a friction trigger system linked to the aft foil 46 by a torsion tube F'.

As shown in FIG. 8, this system includes a cam G' rotated by a roller H which is retracted, compressing one or more springs I as it is retracted, so limiting the torsion forces to the chosen values. Return to the on-axis position is obtained by virtue of the inherent rotational stability of the aft foil 46 which is due to the symmetry of its nominal position, which is stable because of the hydrodynamic forces, or manually using the cam G if the speed of the vessel is too low.

The device also includes a rudder blade assistance system for maneuvering the rudder blade beyond a given force threshold. The rudder bar or the autopilot turns the combination of the rudder blade 45 and the aft foil 46 about its vertical axis O by means of a link J actuating a lever K rotating freely about the axis 0. The lever K rotates the rudder blade 45 through a spring box L. If the resisting force of the rudder blade 45 is less than the setting of the spring box L the drive is direct. On the other hand, if the resisting force of the rudder blade exceeds the setting of the spring box a differential moment appears between the lever K and the rudder blade 45. This rotation is transmitted to a vertical flap V at the lower rear end of the rudder blade 45 and above the foil 46 via a torsion tube P. This rotation moment is amplified by the lever arm ratio produced by a link-crank system N–Q. This turns the flap V articulated to the rudder blade 45 to cancel the differential moment between the lever K and the rudder blade 45; this system therefore constitutes a servomechanism.

As shown in FIGS. 9*a* and 9*b*, the main foils 43, 44 articulated to the respective main booms 37 and 38 rest on a hinged strut 73, 74 maneuvered by a hydraulic cylinder 71, 72 acting against a bracket attached to the main foil and one arm of the strut. In the raised position, the ends 47, 48 of the main foils 43, 44 are accommodated in the spaces 65 and 66 (see FIG. 4).

Referring to FIG. 10, the rear foil, which remains totally submerged under normal sailing conditions, has two outer arms 46, 46' forming an inverted V-shape, with an angle $\alpha$ of 10°, for example. As stated above, as the speed rises, the hull 40 is raised higher and higher above the surface of the water and the aft foil can come dangerously close to the surface. The inverted V-shape of the two arms 46, 46' is intended to prevent sudden disappearance of the lift of the foil 46' should it accidentally break the surface of the water. Under normal sailing conditions, however, it is totally submerged and does not have any heave characteristic.

FIG. 9*a* shows a vertical aileron 100 at the lower end of the forward foils 43, 44, at the root of the horizontal ailerons 47, 48. These vertical ailerons 100 provide automatic stabilization of the hydrofoil at high speeds, when the forward foils are not deeply submerged.

We claim:

1. Wind-propelled hydrofoil having a forward assembly including forward foils that are at least partially submerged and a totally submerged aft foil which therefore has no heave characteristic, the forward foils being such that the resultant of the vertical forces, which has a heave characteristic F:

decreases when said forward assembly moves vertically upwards, and increases when said forward assembly is subjected to an upward pitching movement, wherein the forward foil assembly has an incidence characteristic A and the aft foil has an incidence characteristic R characterised in that:

(a) in sailing conditions the forward foils have a fixed position and the aft foil has a usually fixed position with respect to the hydrofoil;

(b) said forward foils and said aft foil being positioned relative to each other and to the center of gravity of said hydrofoil such that longitudinal stability is provided to said hydrofoil and such that said hydrofoil remains in a state of equilibrium with no control system;

(c) the position of said forward foils and said aft foil with respect to the center of gravity providing the hydrofoil with a stability characteristic which satisfies the following equation:

$$R(d-g)-Ag+F(g^2+r^2)>0$$

in which d is the horizontal component of the distance between the aft foil and the center of heave of the forward assembly, g is the distance between the center of gravity of the hydrofoil and the center of heave of the forward assembly, and r is the gyration radius of the hydrofoil for pitching movements, whereby the hydrofoil is inherently stable in the longitudinal direction.

2. Hydrofoil according to claim 1 wherein said hydrofoil is of the multihull type with a central hull and two lateral floats, said forward foils are supported by the lateral floats and converge symmetrically towards the central hull.

3. Hydrofoil according to claim 2 including booms linking the central hull and the lateral floats and which booms are supported by stays fixed to the central hull, and further including steps extending from the prow of the central hull to at least a fixing point of each stay on the central hull, said fixing point of each stay being disposed above the steps.

4. Hydrofoil according to claim 1 further comprising the aft foil being mounted at a lower end of a vertical rudder blade and being symmetrical on either side of the rudder blade.

5. Hydrofoil according to claim 4 characterized in that the aft foil is mounted on a vertical axle linked to a trigger system so that said aft foil can rotate and retract when subject to a torque higher than a given nominal value.

6. Hydrofoil according to claim 5 characterized in that said mounting of said aft foil is by way of a torsion tube held by a roller adapted to retract, compressing a spring as said roller retracts, to limit torsional forces to said nominal value.

7. Hydrofoil according to claim 4 including a device for rotating the rudder blade about a vertical axis including a drive lever operating a mobile flap mechanically connected to one end of the vertical rudder blade opposite an axle.

8. Hydrofoil according to claim 7 further including a drive device between the drive lever and the mobile flap comprising a link-crank mechanism for amplifying the arm of the lever and a torsion tube linking the link-crank mechanism to the drive lever.

9. Hydrofoil according to claim 8 further including a spring box so that the torsion tube does not transmit any force unless the resisting force of the rudder blade exceeds setting of the spring box (L).

10. Hydrofoil according to claim 2 wherein the forward foils are extended by horizontal ailerons having a chord less than or equal to a chord of a distal end of the forward foils and a span equal to at least three times the horizontal aileron chord.

11. Hydrofoil according to claim 4 including a device for lifting at least one of the rudder blade and the forward foils.

12. Hydrofoil according to claim 4 including a water ballast tank adapted to shift the center of gravity aft when the hydrofoil is sailing at high speed.

13. Hydrofoil according to claim 12 wherein said water ballast tank is automatically fed with water by a tube submerged in the water having an end which faces forward.

14. Hydrofoil according to claim 13 wherein said tube feeding the water ballast tank (80) is inside the rudder blade and has an opening at its lower end which is in a lower part of the leading edge of said rudder blade.

15. Wind-propelled hydrofoil having a forward assembly including forward foils that are at least partially submerged and a totally submerged aft foil which therefore has no heave characteristic comprising the forward foils being such that the resultant of the vertical forces;

decreases when said forward assembly moves vertically upwards, said resultant having a heave characteristic F; and increases when said forward assembly is subjected to an upward pitching movement, with an incidence characteristic A; and further comprising the aft foil having an incidence characteristic R satisfying the following equation:

$$R(d-g)-Ag+F(g^2+r^2)>0$$

in which d is the horizontal component of the distance between the aft foil and the center of heave of the forward assembly, g is the distance between the center of gravity of the hydrofoil and the center of heave of the forward assembly, and r is the gyration radius of the hydrofoil; and said aft foil being adjustable by rotation about a transverse horizontal axis.

16. Wind-propelled hydrofoil havinq a forward assembly includinq forward foils that are at least partially submerged and a totally submerged aft foil which therefore has no heave characteristic comprisinq the forward foils being such that the resultant of the vertical forces:

decreases when said forward assembly moves vertically upwards, said resultant having a heave characteristic F; and increases when said forward assembly is subjected to an upward pitching movement with an incidence characteristic A; and further comprising the aft foil having an incidence characteristic R satisfying the following equation:

$$R(d-g)-Ag+F(g^2+r^2)>0$$

in which d is the horizontal component of the distance between the aft foil and the center of heave of the forward assembly, g is the distance between the center of gravity of the hydrofoil and the center of heave of the forward assembly, and r is the gyration radius of the hydrofoil; and said aft foil has two lateral arms forming an inverted V-shape.

17. Wind-propelled hydrofoil having a forward assembly including forward foils that are at least partially submerged and a totally submerged aft foil which therefore has no heave characteristic comprisinq the forward foils being such that the resultant of the vertical forces:

decreases when said forward assembly moves vertically upwards, said resultant having a heave characteristic F; and increases when said forward assembly is subjected to an upward pitching movement with an incidence characteristic A; and further comprising the aft foil having an incidence characteristic R satisfying the following equation:

$$R(d-g)-Ag+F(g^2+r^2)>0$$

in which d is the horizontal component of the distance between the aft foil and the center of heave of the forward assembly, q is the distance between the center of gravity of the hydrofoil and the center of heave of the forward assembly, and r is the gyration radius of the hydrofoil; and said forward foils have a vertical aileron at a lower end adapted to provide automatic lateral stabilization at high speed.

* * * * *